United States Patent [19]

Inada et al.

[11] 4,313,366

[45] Feb. 2, 1982

[54] ELECTROMAGNETIC VALVE ASSEMBLY

[75] Inventors: Masami Inada; Kongou Aoki, both of Kariya, Japan

[73] Assignee: Aisin Seiki Kabushiki Kaisha, Kariya, Japan

[21] Appl. No.: 105,575

[22] Filed: Dec. 20, 1979

[30] Foreign Application Priority Data

Dec. 25, 1978 [JP] Japan ..... 53/177833[U]

[51] Int. Cl.[3] ..... F15B 13/044

[52] U.S. Cl. ..... 91/459; 137/334; 137/625.65

[58] Field of Search ..... 91/459; 137/334, 625.65

[56] References Cited

U.S. PATENT DOCUMENTS

| | | | |
|---|---|---|---|
| 4,010,674 | 3/1977 | Noddings et al. | 91/459 X |
| 4,128,044 | 12/1978 | Larson et al. | 91/459 X |
| 4,205,593 | 6/1980 | Sakakibara | 137/625.65 X |
| 4,249,457 | 2/1981 | Sakakibara | 137/625.65 |

FOREIGN PATENT DOCUMENTS

| | | | |
|---|---|---|---|
| 2423516 | 11/1975 | Fed. Rep. of Germany | 91/459 |
| 2807994 | 9/1978 | Fed. Rep. of Germany | 91/459 |

*Primary Examiner*—Gerald A. Michalsky

*Attorney, Agent, or Firm*—Oblon, Fisher, Spivak, McClelland & Maier

[57] ABSTRACT

An electromagnetic valve assembly including a housing, a diaphragm member provided in the housing and defining first and second chambers therein, a first heat conducting plate member secured to the diaphragm member, a heat conductive output member secured to the first heat conductive plate member and extending outside of the housing, a heat conductive spring member one end of which is engaged with the heat conductive plate member, the spring member being positioned within the first chamber and normally biasing the diaphragm member in one direction, a solenoid coil positioned in the first chamber energized in repsonse to an electric signal, a contact operatively associated with the solenoid coil movable in response to energization of the solenoid coil, a first and second pressure source, a first valve member controlling fluid communication between the first chamber and the first pressure source in response to movement of the movable contact, a second valve member controlling fluid communication between the first chamber and the second pressure source in response to movement of the movable contact, and second heat conductive plate member positioned between the solenoid coil and an opposite end of the spring member for transmitting heat generated by the solenoid coil to the spring member.

9 Claims, 1 Drawing Figure

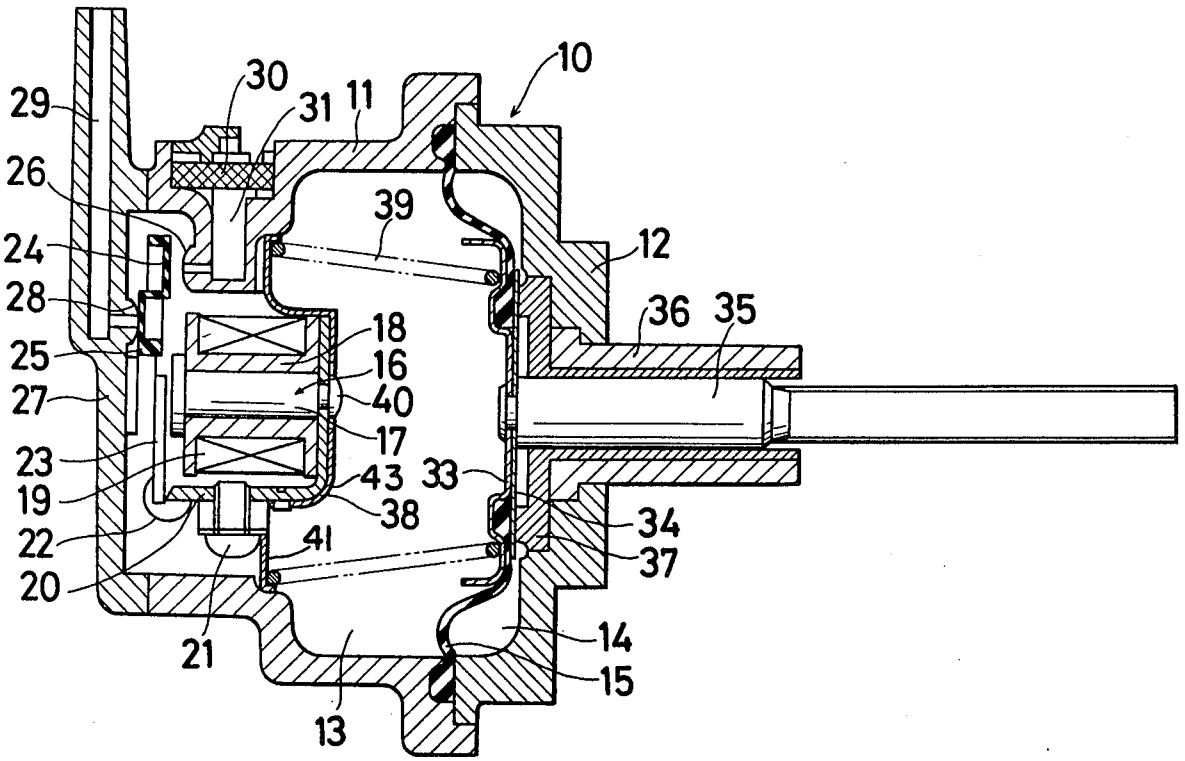
10
11
12
13
14
15
16
17
18
19
20
21
22
23
24
25
26
27
28
29
30
31
33
34
35
36
37
38
39
40
41
43

ELECTROMAGNETIC VALVE ASSEMBLY

BACKGROUND OF THE INVENTION

1. Field of the Invention

The present invention relates to valve assemblies and, in particular, electromagnetic valve assemblies.

2. Description of the Prior Art

In electromagnetic valve assemblies, a problem has existed that if the assembly is formed so as to be smaller in size to reduce cost, the area of heat radiation becomes correspondingly smaller which may result in operational error due to the increase in temperature.

SUMMARY OF THE INVENTION

Accordingly, an object of this invention is to provide an electromagnetic valve assembly which overcomes the drawbacks of the prior art. According to the present invention, the valve assembly is provided with a new and improved heat transmission system which radiates heat to the outside of the housing by providing a heat conductive plate which transmits the heat generated by solenoid energization to an output member located outside of the assembly.

BRIEF DESCRIPTION OF THE DRAWING

Various objects, features and attendant advantages of the present invention will become evident when considered in connection with the accompanying drawing, wherein:

The sole FIGURE illustrates a sectional view of the electromagnetic valve assembly of the present invention.

DETAILED DESCRIPTION OF THE PREFERRED EMBODIMENT

Reference numeral 10 generally designates an electromagnetic valve assembly which has a diaphragm member 15, the outer peripheral portion of which is fixedly secured between a first body 11 made of resin or plastic material and a second body 12 also made of resin or plastic material. Accordingly, the assembly 10 is divided into two chambers 13 and 14 formed by diaphragm member 15 and the two bodies 11 and 12.

Within the first chamber 13 an electromagnetic valve 16 is located which includes a bobbin 18 on which a solenoid coil 19 is wound, a central iron core 17 on which is secured a heat conductive yoke member 20, a leaf spring member 22 one end of which is secured to the yoke member 20 by bolt 21, a movable contact 23 secured to the left spring 22 and in contact with the yoke member 20 and first and second valve members 24, 25, respectively, provided on one end of the spring 22. The first valve member 24 is normally separated from seat 26 provided on the first body 11 by the force of spring 22 while the second valve member 25 normally contacts with seat 28 provided on a member 27 which is secured to the first body 11.

The first chamber 13 is selectively (alternatively) communicable with port 29 formed in member 27 or air port 31 exposed to atmospheric pressure through air filter means 30. Port 29 is, for example, connected with a negative pressure source such as an intake manifold of an automobile (not shown).

A pair of plates or first heat conductive plate member 33, 34 are secured to the inner peripheral portion of the diaphragm member 15. Heat conductive output member 35 is secured to the plates 33 and 34 and is slidably guided by resin member 37 which is secured to the second body 12 through steel member 36. The output member 35 is axially movable together with diaphragm member 15.

A spring 39 is provided within the first chamber 13 between a heat conductive plate or second heat conductive plate member 38 and plate 33 secured to the diaphragm member 15 and normally biases the latter (plate 33 and diaphragm member 15) toward the right as viewed in the sole FIGURE. The heat conductive plate 38 has a central U-shaped cup portion 43 with an outwardly projecting radial flange portion 41 and is connected with the right end projection 40 of the iron core 17 through a hole provided at the central position of plate 38.

The plate 38 is in contact with the yoke member 20 by the biasing force of spring 39. Thus, the heat generated when the valve 16 is operated may be transmitted to the heat conductive output member 35 through plate 38, spring 39 and plates 33, 34.

The output member 35 is, for example, connected to a throttle valve of the automobile (not shown). The valve 16 is, for example, energized by an electric signal generated in response to the operating means of a vehicle cooling device. Accordingly, the valve assembly 10 of this invention may be adopted in a well-known idle control system for automobiles.

In operation, when the solenoid coil 19 is energized in response to, for example, the operation of the vehicle cooling system, movable contact 23 (and accordingly the upper end of leaf spring 22) is moved to the right in the sole FIGURE from the initial position illustrated therein. The valve member 25 is then separated from the seat 28 and valve member 24 comes in contact with seat 26.

Chamber 13, which has been in communication with atmospheric pressure through port 31, is now in communication with the negative pressure source through port 29. Due to the pressure differential between chambers 13 and 14, diaphragm member 15, and plates 33, 34 move toward the left, thus overcoming the biasing force of spring 39. The output member 35 connected to the diaphragm member 15 will also move toward the left so as to change the opening degree of the throttle valve.

As mentioned above, the heat generated by the energization of the solenoid coil may be transmitted to the output member 35 extending outside the assembly through plate 38, spring 39 and plates 33, 34. Accordingly, even if the valve 16 is made compact or the size of valve 16 is reduced, sufficient heat radiation can be obtained through the above heat transmission.

When the solenoid coil is de-energized, the valve members 24, 25 will return to their original positions as shown in the sole FIGURE. As a result, the spring 39 again biases the diaphragm member 15 toward the right so as to return the whole assembly to its original position.

Obviously, many modifications and variations of the present invention as possible in light of the above-teachings. It is therefore to be understood that within the scope of the appended claims, the invention may be practiced otherwise than as specifically described herein.

What is claimed as new and desired to be secured by Letters Patent of the United States is:

1. An electromagnetic valve assembly comprising:

a housing;

a diaphragm member provided in said housing and defining first and second chambers therein;

first heat conductive plate means secured to said diaphragm member;

a heat conductive output member secured to said first heat conductive plate means and extending outside of said housing;

heat conductive spring means one end of which is engaged with said first heat conductive plate means, said spring means being positioned within said first chamber and normally biasing said diaphragm member in one direction;

a solenoid coil having a central core member with a projection extending therefrom, said coil positioned in said first chamber and energized in response to an electric signal;

a movable contact operatively associated with said solenoid coil movable in response to an energization of said solenoid coil, a first and second pressure source;

first valve means controlling fluid communication between said first chamber and said first pressure source in response to movement of said movable contact;

second valve means controlling fluid communication between said first chamber and said second pressure source in response to movement of said movable contact;

second heat conductive plate means having a central U-shaped cup portion with an outwardly protecting radial flange portion positioned between said solenoid coil and an opposite end of said spring means for transmitting heat generated by said solenoid coil to said spring means such that said spring means contacts said flange portions; and said second heat conductive plate means forming a hole for receiving said projection of said central core member.

2. The electromagnetic valve assembly as set forth in claim 1, further comprising:

a yoke member secured to said core member; and a spring member secured to said yoke member wherein said movable contact is secured to said spring member.

3. The electromagnetic valve assembly as set forth in claim 2, wherein said heat conductive plate means contacts said yoke member due to biasing force of said heat conductive spring means.

4. The electromagnetic valve assembly as set forth in claim 2, said first valve means further comprising a first valve member and a first seat member provided on said housing wherein said first valve member is normally separated from said first seat member due to biasing force of said spring member; and said second valve means further comprising a second valve member and a second seat member provided on said housing wherein said second valve member normally contacts said second seat member.

5. The electromagnetic valve assembly as set forth in claim 1, further comprising:

a leaf spring connected to said solenoid upon which said movable contact and said first and second valve means are mounted, and wherein said first and second valve means are in spaced relation with each other.

6. The electromagnetic valve assembly as set forth in claim 5, further comprising:

first and second bodies forming a portion of said housing wherein said bodies comprise plastic material.

7. The electromagnetic valve assembly as set forth in claims 5 or 6, further comprising:

a yoke member to which said central core member is secured wherein said leaf spring is secured to said yoke member and wherein said movable contact is secured to said leaf spring.

8. The electromagnetic valve assembly as set forth in claim 6, said first valve means further comprising a first valve member and a first seat member provided on said housing wherein said first valve member is normally separated from said seat member due to biasing force of said leaf spring; and said second valve means further comprising a second valve member and a second seat member provided on said housing wherein said second valve member normally contacts said second seat member.

9. The electromagnetic valve assembly as set forth in claim 5, further comprising:

a yoke member wherein said heat conductive plate means contacts said yoke member due to biasing force of said heat conductive spring means.

* * * * *